US007475709B2

(12) United States Patent
Halvarsson et al.

(10) Patent No.: US 7,475,709 B2
(45) Date of Patent: Jan. 13, 2009

(54) YARN FEEDING DEVICE

(75) Inventors: Bjorn Halvarsson, Ulricehamn (SE); Patrik Magnusson, Boras (SE); Anders Svanstrom, Ulricehamn (SE)

(73) Assignee: IROPA AG, Baar (CH)

( * ) Notice: Subject to any disclaimer, the term of this patent is extended or adjusted under 35 U.S.C. 154(b) by 166 days.

(21) Appl. No.: 11/583,330

(22) Filed: Oct. 19, 2006

(65) Prior Publication Data

US 2007/0095418 A1 May 3, 2007

Related U.S. Application Data

(62) Division of application No. 10/399,296, filed on Oct. 14, 2003, now Pat. No. 7,156,337.

(51) Int. Cl.
*D03J 1/04* (2006.01)
*D03D 49/50* (2006.01)

(52) U.S. Cl. ..... 139/452; 139/1 E; 139/1 R

(58) Field of Classification Search ..... 242/364.7, 242/364.8, 365.1, 365.3; 139/116.1, 435.1, 139/450, 452

See application file for complete search history.

(56) References Cited

U.S. PATENT DOCUMENTS 3,464,452 A * 9/1969 Brouwer et al. ..... 139/452
3,477,476 A * 11/1969 Brouwer et al. ..... 139/452
3,490,710 A * 1/1970 Wolfgang ..... 242/364.8
3,844,504 A 10/1974 Lawson
4,132,370 A 1/1979 van Mullekom
4,557,299 A 12/1985 Henzl et al.
4,744,393 A * 5/1988 Takegawa ..... 139/116.2
4,746,848 A * 5/1988 Maenaka et al. ..... 318/603
4,756,344 A * 7/1988 Takegawa ..... 139/452
4,815,502 A * 3/1989 Takegawa ..... 139/452
4,827,990 A * 5/1989 Takegawa ..... 139/435.2
4,830,063 A * 5/1989 Takegawa ..... 139/435.2
4,850,400 A * 7/1989 Gorris ..... 139/452
4,886,094 A * 12/1989 Takegawa ..... 139/452
4,911,208 A * 3/1990 Maenaka ..... 139/435.1
4,921,019 A * 5/1990 Kawabata et al. ..... 139/452

(Continued)

FOREIGN PATENT DOCUMENTS

DE 2633474 A 2/1978

(Continued)

*Primary Examiner*—Bobby H Muromoto, Jr.
(74) *Attorney, Agent, or Firm*—Flynn, Thiel, Boutell & Tanis, P.C.

(57) ABSTRACT

The invention relates to a method for inserting weft yarn material, comprising an insertion system in a loom. According to the invention, for every insertion the insertion system (A) is supplied with a substantial part of the weft yarn required for the insertion in a loose and substantially tension-free manner so as to be intermittently pulled off. A tubular package of adjacent windings is produced from the weft yarn material on an inner mechanical support (S) by way of an at least substantially continuous winding process and is conveyed forward in withdrawal direction. For an insertion, a number of windings that corresponds at least approximately to the weft yarn section intended to be inserted is detached or set free from the support while maintaining its tubular configuration without yarn tension. The weft yarn material is withdrawn directly inwardly from the frontmost winding and then further along the tube axis (X).

34 Claims, 9 Drawing Sheets

U.S. PATENT DOCUMENTS

| | | | | |
|---|---|---|---|---|
| 4,932,442 | A * | 6/1990 | Ishido et al. | 139/435.2 |
| 5,080,144 | A * | 1/1992 | Takehana | 139/452 |
| 5,127,445 | A * | 7/1992 | Kakehashi | 139/452 |
| 5,154,209 | A * | 10/1992 | Takegawa | 139/452 |
| 5,440,495 | A * | 8/1995 | Sainen et al. | 700/140 |
| 6,158,480 | A | 12/2000 | Pedrini | |
| 7,156,337 | B2 * | 1/2007 | Halvarsson et al. | 242/364.8 |
| 2007/0095418 | A1 * | 5/2007 | Halvarsson et al. | 139/452 |

FOREIGN PATENT DOCUMENTS

| | | | |
|---|---|---|---|
| DE | 3423771 | A | 1/1985 |
| EP | 0699790 | A | 3/1996 |
| GB | 2107747 | A | 5/1983 |
| WO | WO 92/04490 | | 3/1992 |

* cited by examiner

YARN FEEDING DEVICE

This application is a divisional of U.S. patent application Ser. No. 10/399,296 filed Oct. 14, 2003, which issued as U.S. Pat. No. 7,156,337, the disclosure of which is hereby incorporated by reference.

FIELD OF THE INVENTION

The invention relates to a yarn feeding device for a weaving machine, and to a method of inserting weft yarns into a weaving machine.

BACKGROUND OF THE INVENTION

According to known methods a winding package consisting of contacting or separated and spaced apart windings is formed on a storage body. The insertion system pulls the yarn from the winding package over the front end of the storage body. The windings on the storage body may be advanced forward by different advance assemblies. The storage body is axially longer than the winding package. During withdrawal a yarn balloon is formed which generates significant yarn tension variations and a considerable yarn tension which both delay the insertion. In order to achieve high insertion speeds a considerable energy input thus is needed in the insertion system. On the other hand this means a high mechanical load for the weft yarn. The most important drawback is the long insertion time dictated by this method, i.e. the time period between the start of the insertion and the arrival of the then stopped weft yarn at the opposite fabric edge. The basically very high efficiency potential of modem weaving machines cannot be used satisfactorily due to the long insertion time of such known insertion methods. Furthermore, other methods are known according to which the insertion system does not directly withdraw the weft yarn from the winding package on a storage body but instead weft yarn material is presented for the insertion system in loose and substantially tensionless condition. The influence of a yarn balloon is avoided thereby such that higher insertion speeds can be achieved with low energy input while the weft yarn material is treated with respect. For example, a weft yarn portion is presented by mechanical means in zigzag form or loop form. The mechanical means release the weft yarn portion in synchronism with the withdrawal motion. The method needs high efforts in terms of the devices but is too slow for modem weaving machines because of the mass inertia of the mechanical elements and a plurality of very precisely controlled movements of the mechanical elements.

There are further methods according to which the weft yarn is presented by mechanical means in a single large loop to the insertion system. The loop is released with the start of the insertion. In this case an undesirably large space is needed and the achievable insertion speeds are limited.

Finally, it is known to present the weft yarn section to the insertion system loosely and substantially without tension in random configuration in the interior of a cavity. The random configuration of the weft yarn section easily might lead to disturbances due to weft yarn breakages and yarn tension variations during the withdrawal.

It is an object of the invention to provide a method and a yarn feeding device, as mentioned above, which allow to achieve optimal short insertion times with low energy consumption and high operational safety in highly efficient modem weaving machines.

Said object is achieved by the features of the yarn feeding device and method as disclosed herein.

Surprisingly, the winding package portion set free from the support for the withdrawal in orderly arranged windings shows a tendency, among others, due to the inherent inertia property and the form stability of the windings, to safely remain in a tubular configuration in the free space even without any mechanical inner suspension and such that the weft yarn during withdrawal first runs inwardly from the tube without forming any balloon and then runs further centrally and consumes the windings from the tube in a clean fashion, even up to the last in-fed winding which may still be supported on the support. The released winding package section does not collide. The windings do not tend to entangle or to collapse, provided that the withdrawal is carried out rapidly and in a timewise precisely controlled adaptation to the release of the winding package section. Astonishingly short insertion times can be achieved by the method. The astonishingly short insertion times allow to optimally use the capabilities of modern weaving machines in terms of high yarn speeds and high insertion frequencies. The released yarn package section may be supported from the outer side. Such a suspension, however, is more a safety measure. Expediently, the winding on speed of the substantially continuous winding process may be matched with the insertion frequency and the length of the respective inserted weft yarn section such that each insertion substantially consumes the released winding package section before a subsequent winding package section is released. Even in case of extremely high yarn speeds it can be seen that the centrally withdrawn weft yarn does consume the first winding in withdrawal direction substantially radially inwardly and without any ballooning and that the tubular configuration of the windings in the released winding package section is maintained till the end of the insertion with optimum yarn geometry. The released winding package section may contain a number of yarn windings which substantially correspond to the weft yarn length which is to be inserted, or may contain a larger number corresponding to several weft yarns which are to be inserted one after the other.

It may be expedient to overlap the withdrawal timewise with the release of the winding package section such that the released winding package section or the windings at the withdrawal side of the winding package section, respectively, have as little time as possible to leave the tubular configuration of the orderly arranged windings.

The method can be carried out in a simple way if the windings in the winding package section are set free by axial overfilling of the inner support beyond the withdrawal side end of the support. The released windings are consumed during the withdrawal before the released winding package section can collide or get into a state of disorder. The overfilling is carried out by continuous winding on of new weft yarn material.

Alternatively or additively the windings may be released by advancing the winding package on the support beyond the withdrawal side end of the support. In this case advance assemblies of any suitable kind may be employed.

In order to maintain the tubular configuration of the released yarn package section as stably as possible, and in order to optionally even use the natural adhesion between the contacting windings, the winding package and the released winding package section may be conveyed in withdrawal direction obliquely upwards.

A further alternative may be to release the windings in the winding package section released for withdrawal by a respective conveying movement or adjusting movement of at least a part of the support. In this case mechanical adjusting devices of the support may be employed.

It is important for the course of the method to extend the tendency of the released winding package section to remain freely in space without inner mechanical suspension as long as possible. This tendency also depends on the form stability of the yarn material and the windings and from the at least preliminarily inherent form stability of the winding package section. The form stability is good when the windings are wound on the support with a curvature of the yarn material which at least substantially corresponds to the smallest natural and unforced capability of the weft yarn material to store a curvature. Said capability to store the curvature may be explained as follows: a section of the weft yarn material is laid on a smooth surface. Both ends of the section are brought towards each other as close as possible. By this the weft yarn section receives a certain curvature. If then both ends are released, the weft yarn section will relax into a residual curvature representing the smallest natural capability to store a curvature. Surprisingly, it has been found that different weft yarn materials behave only slightly differently or behave even very similarly. In case that the weft yarn material in the winding package is wound at least substantially with the smallest natural capability to store a curvature, then the windings in the released winding package section will not have a considerable tendency to increase or decrease the winding radius themselves such that the released winding package section maintains the tubular configuration formed by the winding process on the inner support relatively long even if there is no further support from inside. Any adhesion between the equally formed contacting windings can support this effect.

In case of insertion methods employing an insertion system which itself cannot precisely measure the length of the respective inserted weft yarn section it may be expedient to mechanically measure the weft yarn section between the insertion system and the winding package section remaining on the support. For that purpose mechanical systems may be employed which are controlled in adaptation to the weaving cycles.

The yarn feeding device is designed predominantly but not restrictive for the measurement of the weft yarn length for a weaving machine which is unable to measure the weft yarn length by itself, e.g. a jet weaving machine. In order to hardly influence the formation of the yarn winding package and the release of the yarn winding package section by the measurement or the definition of the correct weft yarn length for each insertion, the engaging stop element is moved into the stop position without using a separate drive, but by the forward moving yarn winding package only. The stop element is brought into the engagement position just in front of a winding just generated on the support and in a position suitable for measuring the length without interfering with the conveying movement of the winding package. Then the stop element drifts with the forwardly conveyed winding package until finally the stop position is reached where the stop element defines the end of the withdrawn weft yarn length. In order to bring the stop element later again into the home position, a power drive is provided which moves the stop element exclusively in the moved away release position and substantially opposite to the withdrawal direction while at the same time yarn windings can be withdrawn without hindrance by the moved away stop element. This results in a stepwise method run during which the power drive always returns the stop element while the yarn package moves the stop element forward. In the engaging stop position the stop element is responsible for the termination of the insertion.

Expediently, the stop element functionally co-operates with a yarn clamp which is responsible for the start of the insertion and which is controlled in timewise adaptation to the operation movements of the stop element. The yarn clamp holds the weft yarn firmly while the disengaged stop element is returned to the home position. The yarn clamp releases the weft yarn first precisely at the start of the insertion cycle. The insertion then is terminated when the engaging stop element has reached the stop position and is caught at the stop position, before the yarn clamp again holds the yarn in preparation for the return motion of the stop element.

When the stop element terminates the insertion in the engaging stop position, the weft yarn may be subjected to a significant longitudinal tension between the stop element and the insertion system or between the stop element and even the weaving machine. The longitudinal tension acts backwards at least towards the stop element. The weft yarn section between the yarn clamp adjusted into the clamping position and holding the yarn and the stop element as well will remain under longitudinal tension. In case that then the stop element would be moved from the engaging stop position into no longer engaging the release position, the tension depending friction of the weft yarn at the moving stop element could disturb the tubular configuration of the yarn winding package. Furthermore, the unavoidably occurring relaxation of the tensioned yarn during the movement of the stop element into the release position also could cause a disorder of the tubular configuration of the yarn windings. However, by means of the auxiliary drive the yarn clamp holding the yarn can be adjusted such that by an adjustment travel of the yarn clamp in the direction towards the stop element still positioned in the engaging stop position the weft yarn section extending therebetween becomes gradually relaxed and will be totally relaxed as soon as the stop element then moves into the release position for the next insertion. This adjustment of the yarn clamp avoids damages to the tubular configuration of the yarn winding package. Basically, it also may be expedient, to move the yarn clamp out of the moving space of the yarn at least in the final phase of an insertion, e.g. with the help of a further actuator or even with the same auxiliary drive. This minimises the danger that the yarn might be caught by the yarn clamp. Under certain conditions it might suffice to move a shield for a short while over the clamping region of the yarn clamp, or to provide a deflector at the yarn clamp or adjacent to the clamping region of the yarn clamp which deflector then guides the yarn sidewardly past the clamping region, namely at the sides from which the yarn normally enters the clamping region.

In order to move as little mass as possible during the movement of the stop element in withdrawal direction by the yarn winding package, a hinge should be provided between the stop element and the power drive of the stop element. Furthermore, the stop element ought to be guided in its moving direction in order to have precise positioning at least in the stopping position which is important for measuring the yarn length. The guidance either may be achieved by a defined hinge axis perpendicular to the withdrawal direction and/or a guiding curve in the support or even in a structure adjacent to the support at the outer side, which guiding curve then may extend exactly in this direction.

A power drive on a magnetic basis is constructionally simple and functionally safe. A stationary solenoid pulls or pushes the at least partially magnetically conductive stop element in the released position back into the home position by using the hinge. Alternatively, for the same purpose other drives might be employed instead.

A correct positioning of the stop element in the stop position may be achieved by a stop provided in the guiding notch either in the support or in the outwardly located adjacent structure. The yarn winding package moves the stop element in conveying direction against the stop.

Since by an abrupt stop of the withdrawn weft yarn in the stop position of the stop element unavoidably a whiplash effect or sudden stretching occurs in connection with a momentary yarn tension rise in this technique, conventionally a controlled yarn brake (end-of-insertion-brake) is employed which dampens the tension rise. Such controlled yarn brakes are expensive and need a complicated control system. For this reason and according to the invention in a structurally simple way the yarn instead is dampened at the stop position of the stop element precisely at the location where the whiplash effect or the stretching effect occurs, namely at the stop element; The dampening is carried out by deflecting the stop element counter to a predetermined elastic counter force essentially in circumferential direction of the support and by the energy which is transferred on the stop element by the stop the weft yarn. By deflecting the stop element counter to the elastic counter force the weft yarn is decelerated gradually and energy will be dissipated to significantly alleviate or remove the weft yarn tension peak. For this reason a controlled yarn brake can be omitted here.

The above-mentioned function e.g. can be achieved by using a stop element which itself is designed for an elastic return behaviour, e.g. with a springy hinge portion such that the stop element is deflected like a bending spring only under the energy increase of the whiplash effect to alleviate the yarn tension rise. Alternatively a sidewardly positioned retainer could be provided for the stop element in the support or in the structure adjacent to the support. The retainer then is temporarily dislocated sidewardly under the force of the weft yarn counter to the predetermined counter force and together with the sidewardly moving stop element in order to dissipate energy. As soon as the whiplash effect is over the retainer or stop element, respectively, is returned in circumferential direction into the predetermined correct length defining stop position.

The yarn clamp which is responsible for the start of the insertion has considerable importance since the point in time of the release of the weft yarn has to be adapted very precisely to the operation of the weaving machine and since only a very short time should expire between the command to start the insertion and the actual release of the weft yarn. For that reason the yarn clamp is used as the trigger of the insertion. The yarn clamp should occupy as little space in the yarn path and should act just as close in front of the front end of the support that the released yarn package section can be set free for the insertion with the desired size and without any mechanical interference. The adjustability of the yarn clamp in withdrawal direction, either in a linear or a pivoting motion, is important in order to relax the weft yarn section provided between the yarn clamp holding the yarn and the stop element positioned in the stop position after the insertion, and, under certain conditions, to move a yarn disturbing part of the yarn clamp at least substantially out of the yarn moving area. A step motor is e.g. a useful rotational drive. A solenoid assembly can be used as a linear drive.

An effective clamping at a small spot and with precisely adjusted clamping force may be achieved by a notch-like clamping region in a slim protrusion of the yarn clamp. The clamping force is mechanically generated by spring force. This can be done, because the clamping action for the yarn is of timewise secondary importance since then the weft yarn is caught by the stop element anyway. The spring force has to assure that the clamping force is sufficient for safely holding the weft yarn back even under tension produced by the insertion system.

Of importance is, however, that the yarn clamp releases the weft yarn precisely at the desired point in time and as rapidly as possible, when an insertion is to be introduced. This can be achieved by a switching solenoid in a functionally simple way. The armature of the switching solenoid is in an initial position with an intermediate predetermined distance from a bolt tightly holding the weft yarn while the switching solenoid is excited. Thanks to the intermediate distance the armature has sufficient time to overcome the static starting friction and to convert the increasing magnetic force in high speed and to build up high kinetic energy and to accelerate strongly before the armature hits the bolt. The switching solenoid then does not need to overcome the spring force by accelerating the armature from speed zero, but overcomes the counter force of the spring abruptly by the then accelerated and by the high kinetic energy of the armature. This results in an abrupt release of the clamped weft yarn. In practice, release times in a range of only one millisecond can be achieved.

While the yarn winding package has the tendency to keep the tubular configuration for a longer time in its released section which is no longer suspended from the inner side, it may be expedient, to then support the yarn winding package from the outer side at least in certain regions on guiding surfaces. The suspension from the outer side maintains the tubular configuration and allows during withdrawal to withdraw the weft yarn from the first winding radially inwardly and then along the prolongation of the axis of the support such that no balloon is formed which could cause a delay and could dissipate energy, and such that the desired high insertion speeds or the short insertion times, respectively, are achieved.

The guiding surfaces could be formed such that they suspend at least the lower half of the released yarn winding package section. In some cases even a bigger part or even the entire yarn winding package section may be suspended. In this case the guiding surfaces could be formed by surface parts or rods or the like in order to generate as low friction as possible on the released yarn winding package section, or to generate friction only there where it might be expedient, e.g. at an upper location at the front most windings in withdrawal direction in order to prevent that those windings may inadvertently tilt forwardly.

Alternatively or additively at least a part of the guiding surface may be inclined upwardly in withdrawal direction. This contributes to maintain the released yarn winding package section compact and dense while it moves forwards, and even during withdrawal of the yarn.

A further alternative may be to move the guiding surface together with the forwardly conveyed yarn winding package in order to keep friction influences between the guiding surface and the yarn winding package as low as possible. This may be achieved, e.g. by a caterpillar structure of driven guiding surfaces which hold and convey the yarn winding package from the outer side like spaced apart gear wheels. At the end of an insertion even the last yarn winding on the support may be consumed up to the stop element in the stop position. The undesirable whiplash effect or stretching effect could then lead to an undesirable increase of the weft yarn tension. For that reason a hold-back element with the shape of a lamella or a brush could be provided on top of the yarn winding package. The element co-operates with the front end of the support to slow down the weft yarn speed before the weft yarn comes to a total standstill at the stop element. This element has to be adjustable such that it comes into action only at the respective desired point in time, namely at the end of the insertion, but does not influence the released yarn winding package section during the remaining time period.

In a structurally simple way the support is designed as a rod cage. The fingers of the rod cage may have individual eccentric adjustment devices with a common adjusting eccentric which is accessible from the front side of the support. In this way diameter variations of the rod cage can be made comfortably. Since the support for carrying out the method has a relatively small diameter, approximately corresponding to the smallest natural and unforced capability of the weft yarn material to store a curvature, a simple eccentric adjustment device is enough, because a diameter variation corresponding to the length of one yarn winding only requires a relatively small radial adjustment stroke.

Here two possibilities can be realised. The adjusting eccentric either is rotated in the carrier and displaces the finger outwardly or inwardly, or the adjusting eccentric is rotated in the finger and is displaced within the carrier together with the finger and via the eccentric portion.

An outer diameter between about 20 mm and about 50 mm is expedient for the support, preferably between about 30 mm to about 40 mm. This is a diameter range corresponding to the smallest natural and unforced capability to store a curvature of most of the weft yarn materials processed nowadays.

Since, of course, any disturbance of the tubular configuration of the yarn winding package is to be avoided in order to achieve a yarn winding package as homogenous and stable as possible, and also a stable, homogenous released yarn winding package section, it may be expedient to provide the stop element at the lower side of the support where the gravitation force contributes towards avoiding disturbing influences of the stop element.

The yarn clamp should substantially be aligned in the direction of the stretched out yarn with the region at which the stop penetrates into the support.

According to a very important aspect of the invention the operational safety of the method can be improved significantly by a loop-suppressing body centrally provided at the support and projecting substantially in alignment with the support axis in withdrawal direction such that its free end is positioned at a location with a distance in front of the support. The basic advantages of the method are extremely high insertion speeds or short insertion times, respectively. This positive effect results from the fact that the yarn during withdrawal out of the frontmost winding of the released winding package section directly runs substantially radially inwardly and first then in axial direction into the weaving machine, and without any balloon formation. This yarn movement is carried out with very high speed and a high dynamic. Since the windings in the released winding package section are not supported from the inner side but remain so to speak freely in the space, particularly in case of lively yarn quality occasionally snarls may be formed which would lead to fabric faults if inserted while twisted or which then could cause disturbances in the insertion system, respectively. The snarl suppressing body supports the yarn run there where the yarn runs substantially radially inwards from the frontmost winding and then further in axial direction. In this region the suppressing body hinders by its structural presence that a snarl may get twisted. Instead the untwisted snarl will be pulled open again. The contact occurring during the running dynamic of the yarn with the suppressing body significantly also calms the yarn which then moves relatively linearly in axial direction into the insertion system.

Expediently, the snarl suppressing body has a coat surface which is rotationally symmetrical and which is tapered towards the free end. This assures that a formed snarl will slide off there and hinders that the snarls gets twisted. The shape also hinders that the snarl even might tend to wrap and tighten around the body under the withdrawal tension.

Structurally simple the snarl suppressing body is a pin, preferably a conical pin. The pin offers an ideal possibility for placing a withdrawal sensor there for registering each withdrawn winding.

The outer diameter of the pin should, at least close to its free end, only amount to a fraction of the diameter of the support.

The free end should markedly project beyond the front side of the support in order to function also in the region in which the yarn is running inwardly from the released winding package section. Preferably, the free end even is located in withdrawal direction downstream of the position of the yarn clamp in order to reach into an area downstream where snarls are no longer formed and where no danger exists that a snarl could get twisted and could form a knot.

The coat surface should be smooth and should have a low coefficient of friction, optionally the coat surface should have a low friction overlay. Low friction has the meaning that the surface should generate only low friction with the yarn material. This is because the suppressing body only by its bodily presence and extension substantially in withdrawal direction has to effect that snarls which are in process of being generated cannot be twisted. The body should impose as little mechanical and delaying load as possible on the yarn.

Expediently the forward advancing movement of the winding package is initiated by means of a predetermined conicity of the support. The cone-conveying principle leads to the advantage of directly contacting yarn windings which then also may stick to each other in the released yarn winding package section. Furthermore, this is a low cost and safe solution.

Alternatively an advancing principle employing a wobbling element in the support may be used which is driven in synchronism with the winding the element, does not rotate but generates a wobbling motion due to its inclined axis which wobbling motion is transferred onto the first yarn winding exiting from the winding element and being formed on the support. The first yarn winding then pushes further the downstream yarn windings.

As a further alternative the yarn winding package can be advanced axially with so-called yarn separation generated by driven advancing elements. The advancing elements are placed between the fingers or rods of the rod cage and use e.g. a common drive hub which has a skew axis in relation to the axis of the support or the drive axis of the winding element, respectively.

Basically, the yarn winding package section when presented for withdrawal without tension and loosely, is released by overfilling the support. As an alternative, the support may be pulled back in relation to the yarn winding package and opposite to the withdrawal direction in order to release the yarn winding package section at the right moment. In this case an assisting strip member may contribute to release the yarn winding package from the pulled back support in compact form and in tubular configuration.

According to a further alternative an auxiliary support is associated to the front side of the support. The auxiliary support is used to first form a yarn winding package supported from the inner side. Thereafter, the auxiliary support is coaxially pulled away from the support in order to release the yarn winding package section which is intended to be inserted. In this case the pull-back of the auxiliary support can be assisted by a stripper member which may be of advantage to keep the released yarn winding package section in compact shape.

The stretching effect or whiplash effect at the end of an insertion into a jet weaving machine fed by weft yarns originating from a measuring feeding device is a mechanical consequence of the abrupt deceleration of the inserted weft yarn at the stop element. In order to avoid damages, in practice controlled yarn brakes are employed which start to brake in advance before the weft yarn is caught at the stop element and which gradually decelerate the weft yarn. Controlled yarn brakes of this kind need a precise electronic control system and are complicated and costly. According to an important aspect of the invention the stop element itself which is responsible for the whiplash effect or the stretching effect when reaching the stop position, is used for dampening or attenuating the yarn tension rise at the end of an insertion. That is, the attenuation is carried out in the weft yarn exactly at the location where the undesirable yarn tension rise would come from. For that purpose the stop element can be deflected counter to a predetermined elastic force and over a dampening stroke substantially in circumferential direction of the support. In more detail, the stop element is adjusted from a first catching position in which it starts to decelerate the weft yarn over the dampening stroke into a second catching position and is loaded by the reaction force from the weft yarn, such that energy is dissipated before the weft yarn is totally stopped. The stop element then is returned by the predetermined elastic force. In toto this allows a very good yarn control resulting without yarn breakage in a finally linearly stretched weft yarn.

For this case it may be expedient to provide at least one hinge region between the linear drive which controls the stop element between the engaged position and the released position, and the support. The hinge region allows the sideward movability or this degree of freedom of the stop element without the necessity to accordingly move the linear drive as well. The damping element movably arranged with a predetermined moving direction in a stationary guide can yield against spring force. The damping element is moved by the stop element by the reaction force of the weft yarn counter to the spring force and over the dampening stroke, such that energy is dissipated and that the yarn is braked gradually without suffering from a significant yarn tension rise. The damping element does not need to move strictly in circumferential direction of the support, but could instead move obliquely in a direction approximately corresponding with the orientation of the resulting yarn reaction force at the stop element. The orientation results from the substantially circumferential force of the yarn extending between the last winding at the withdrawal side and the stop element and the substantial axial force of the downstream yarn portion. The automatic return of the damping element after the compensation of the yarn tension peak offers the advantage to then also pull back the weft yarn at least for a small distance.

In an alternative embodiment the yarn winding package already is formed with several yarn windings which are larger than adjacent ones and which define engagement locations for a respective one out of a plurality of stop elements. The stop elements may be formed like hooks and can e.g. be turned and move together with the yarn winding package such that they sequentially may engage in the enlarged windings. This particularly expedient when the yarn winding package is formed with a size which represents a weft yarn length for several subsequent insertions.

BRIEF DESCRIPTION OF THE DRAWINGS

Embodiments of the invention will be explained with the help of the drawings wherein.

DETAILED DESCRIPTION

Figure 1:
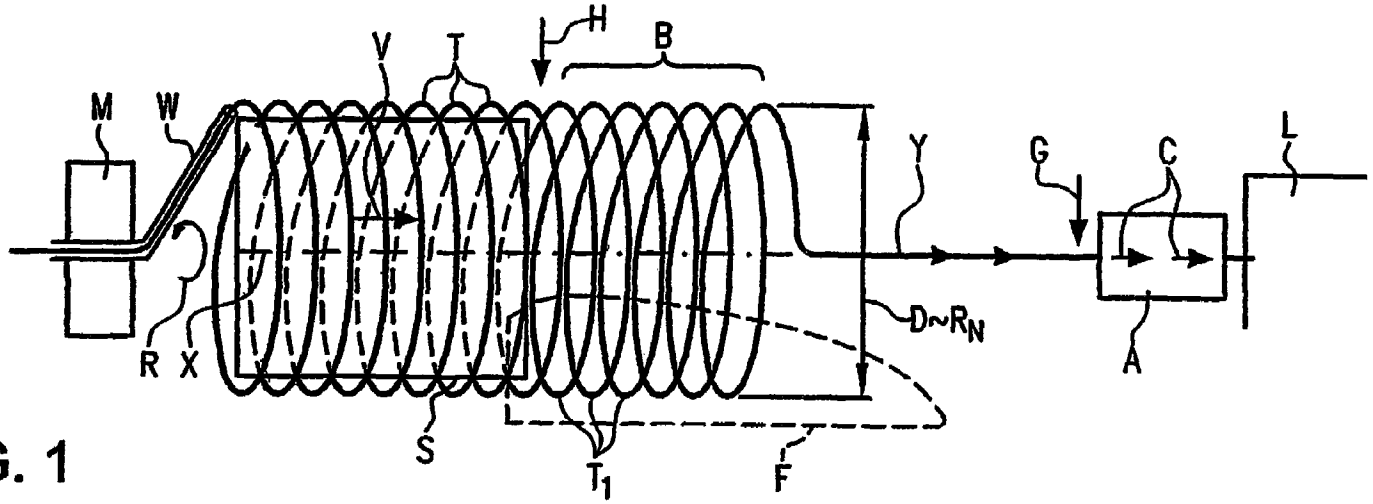
FIG. 1 is a schematic illustration of the course of a method according to the invention, i.e. a method for inserting weft yarn sections into a weaving machine.

In FIG. 1 endless weft yarn material Y, e.g. coming from a not shown yarn supply, is pulled into a rotating winding element W which is moved by a drive M with a substantially continuous rotational winding movement R. The weft yarn material Y is wound by the winding element W on an inner mechanical support S in subsequent or adjacently placed windings T as a tubular winding package which moves forward on the support S by a speed V in the direction of an arrow. The windings T then are set free in a winding package section B beyond the end of the support S in withdrawal direction and further in the direction of the axis X from the support S, while they maintain the tubular configuration. In the set free winding package section B the windings T1 are conveyed forward loosely and substantially without tension. Due to inertia and the form stability of the winding package the windings T1 remain free in the space. Approximately in alignment with the axis X an insertion system A of a weaving machine L is provided which insertion system A withdraws the weft yarn Y intermittently (indicated by single arrows C) and inserts each weft yarn Y into a weaving machine L. Between the insertion system A and the winding package section B set free from the support S at one side and/or in the region of the end of the support S at the other side, mechanical assemblies H and G may be provided for measuring the respective correct weft yarn length for an insertion. Those assemblies H, G are controlled in adaptation to the weaving cycles. The weft yarn Y withdrawn from the set free winding package section B essentially coaxial to the axis X consumes the respective first winding in withdrawal direction without any balloon formation and runs substantially radially inwards and then further axially, e.g. such that finally all windings T1 of the set free winding package section B may be consumed at the end of the insertion. Subsequently, the next following winding package section for the next following insertion is set free.

The winding package consisting of the windings T and the winding package section B are of round or polygonal tubular configuration. At least in the winding package section B the windings T1 are more or less densely contacting each other, are arranged in good order and have substantially the same form. The diameter D of the winding package is selected such that the winding curvature corresponds at least approximately to the smallest natural and unforced capability of the weft yarn material to store a curvature.

Figure 2:
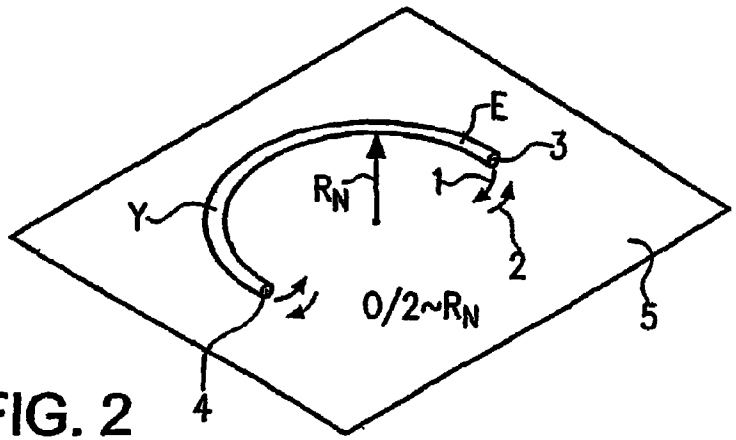
FIG. 2 is a perspective schematic illustration explaining the so-called smallest unforced capability of a weft yarn material to store a curvature.

FIG. 2 illustrates what is meant by the smallest natural and unforced capability to store a curvature. A section E of the weft yarn material Y is laid on a smooth surface 5. Both ends 3, 4 of the section A are moved in the direction of the arrows 1 to each other and then are released. The section E returns by its inherent elasticity in the direction of the dotted arrows 2 to the shown position in which the section has a residual curvature the radius RN of which corresponds to the smallest natural and unforced capability of this weft yarn material to store a curvature. This radius RN of the curvature corresponds approximately to half of the diameter D of the winding package in FIG. 1.

Figure 3:
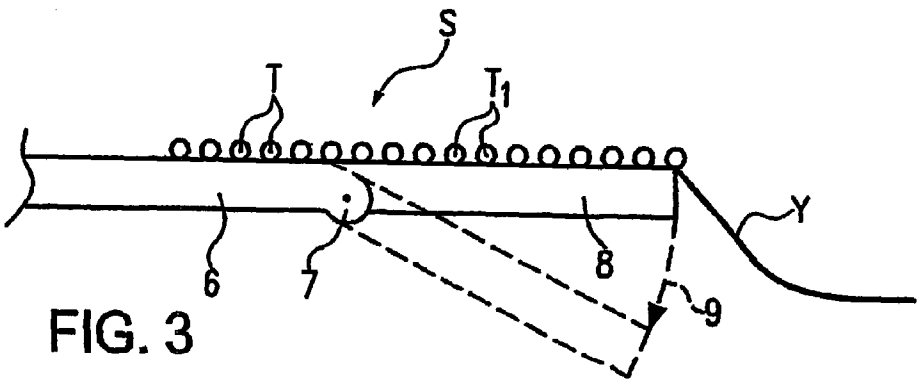
FIG. 3 is a detail variant.

FIG. 3 explains schematically another variant for carrying out the method. The inner support S on which the weft yarn winding package is formed by a substantially continuous winding process has rearward stationary elements 6 and frontward (in withdrawal direction) located elements 8 which can be displaced inwardly and which e.g. are connected via respective hinges 7 with the elements 6. By means of a corresponding control system for the movement in the direction of the dotted arrow 9 the windings T1 which are pushed forward during the winding process are set free for withdrawal similar as shown in FIG. 1 by displacing the elements 8 of support S inwardly.

Figure 4:
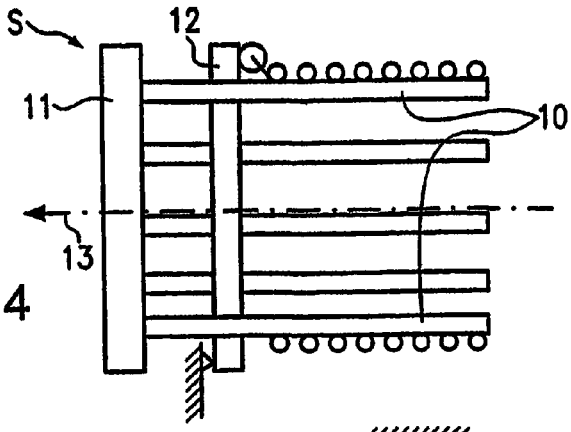
FIG. 4 is a further detail variant.

In FIG. 4 the support S includes e.g. cage-like provided elements 10 on a carrier 11 carrying the elements 10, and, in some cases, also a stationary retainer 12. By pulling back the carrier 11 in the direction of the arrow 13 a desired number of windings is set free from the support S for withdrawal. Alternatively, it may be possible to set free the windings by pushing the retainer 12 forward.

Figure 5:
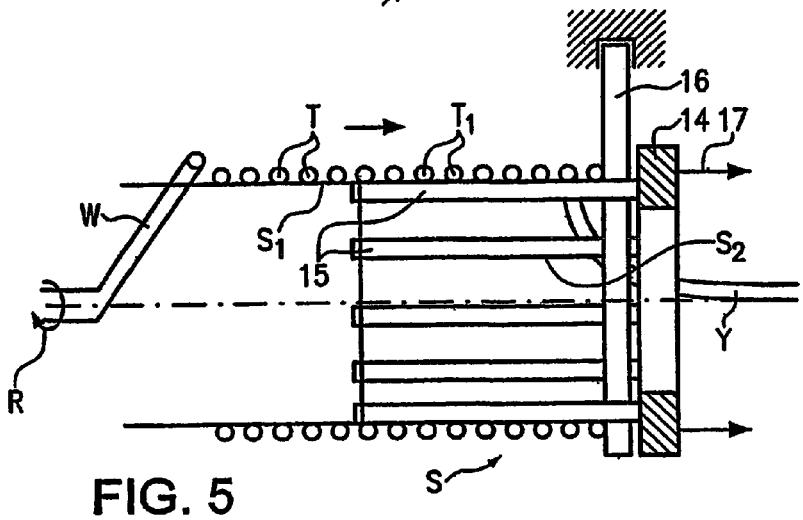
FIG. 5 is a further detail variant, prior to the start of withdrawal.
Figure 6:
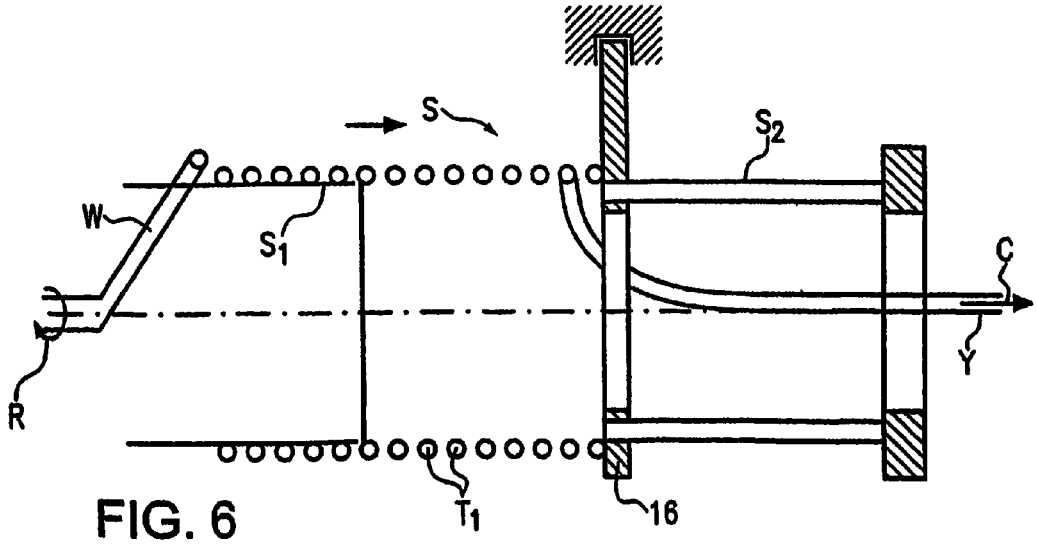
FIG. 6 is the detail variant of FIG. 5 after the start of withdrawal.

FIGS. 5 and 6 show a further variant of the method. The support S consists of a stationary support section S1 on which the winding element W forms the winding package with the windings T, T1 with the help of a substantially continuous winding movement R. In withdrawal direction in front of the support section S a further, e.g. coaxial auxiliary support S2 is provided. The auxiliary support S2 is inwardly open and includes rod-shaped elements 15 constituting a cage-like configuration connected to a carrier 14. The elements 15 prolong the support section S1 in withdrawal direction as long as the carrier 14 remains in the position as shown in FIG. 5. In some cases a stationary stripper member may be provided, although this member is not necessary in any case. As soon as by overfilling the support section S1 a predetermined number of windings T1 is formed on the support part S2 in tubular configuration the carrier 14 together with the element 15 is pulled away rapidly in the direction of the arrow 17. By this action the windings T1 are set free. From the first winding in withdrawal direction the weft yarn Y then runs inwardly and in withdrawal direction through the stripper member 16 and the carrier 14 which are formed with inner through openings.

In FIG. 6 the windings T1 already are set free. The support section S2 is adjusted into the right end position. By the withdrawal of the weft yarn Y indicated by the arrow C the set free windings T1 are successively consumed back to the support section S1. After that the support part S2 again is returned into the position shown in FIG. 5, such that by overfilling the support section S1 again windings T1 may be brought into the tubular configuration and can be pushed off from the support part S1.

With the method variants of FIGS. 3-6 also the assemblies H, G for measuring the weft yarn length may be used, e.g. for an insertion system A which is not able to measure the inserted weft yarn length by itself, e.g. in case of a jet weaving machine. The assembly H, e.g. directly co-operating with the support S, may be a controlled stop device with a stop element used to terminate an insertion by catching the weft yarn material Y, while the other assembly G may be controlled yarn clamp which initiates the start of an insertion by an opening stroke.

In all above described method variants the winding package produced by the winding process is pushed forwards by the winding process itself. Alternatively or additively even advance elements or advance assemblies may be employed which convey the windings forward. It is even possible to operate on the support S with a separation (pitch) between adjacent yarn windings.

For safety's sake (in FIG. 1 indicated in dotted lines) a mechanical (or pneumatic) guiding surface arrangement F may be provided for the winding package section B set free from the support S. The guiding surface arrangement acts on the set free windings, however, exclusively from outside. The suspension by the guiding surface arrangement F is not a must, may, however, be of advantage in order to prevent collapsing or lowering of the set free winding package section B. Furthermore, it is possible, to provide means which engage at the set free winding package section B exclusively on top and from the outer side which means suppresses that the first windings T1 at the withdrawal side in the set free winding package section B may tilt forward. Those means as well as the suspension by the guiding surface arrangement S do not have any influence on the balloon free consumption of the windings T1 during the central inward withdrawal of the weft yarn Y in the direction of the axis X of the winding package section B. The diameter D e.g. may lie in a range of about 30 mm. Special yarn qualities, however, may demand a larger or even a smaller diameter D. Experience has shown that a wide variation of yarn qualities and yarn counts have a very similar smallest natural and unforced capability to store a curvature corresponding to a radius of the curvature of about 15 mm.

The method is not only intended for jet weaving machines but may as well e.g. be employed with gripper weaving machines, rapier weaving machines and projectile weaving machines.

Figure 7:
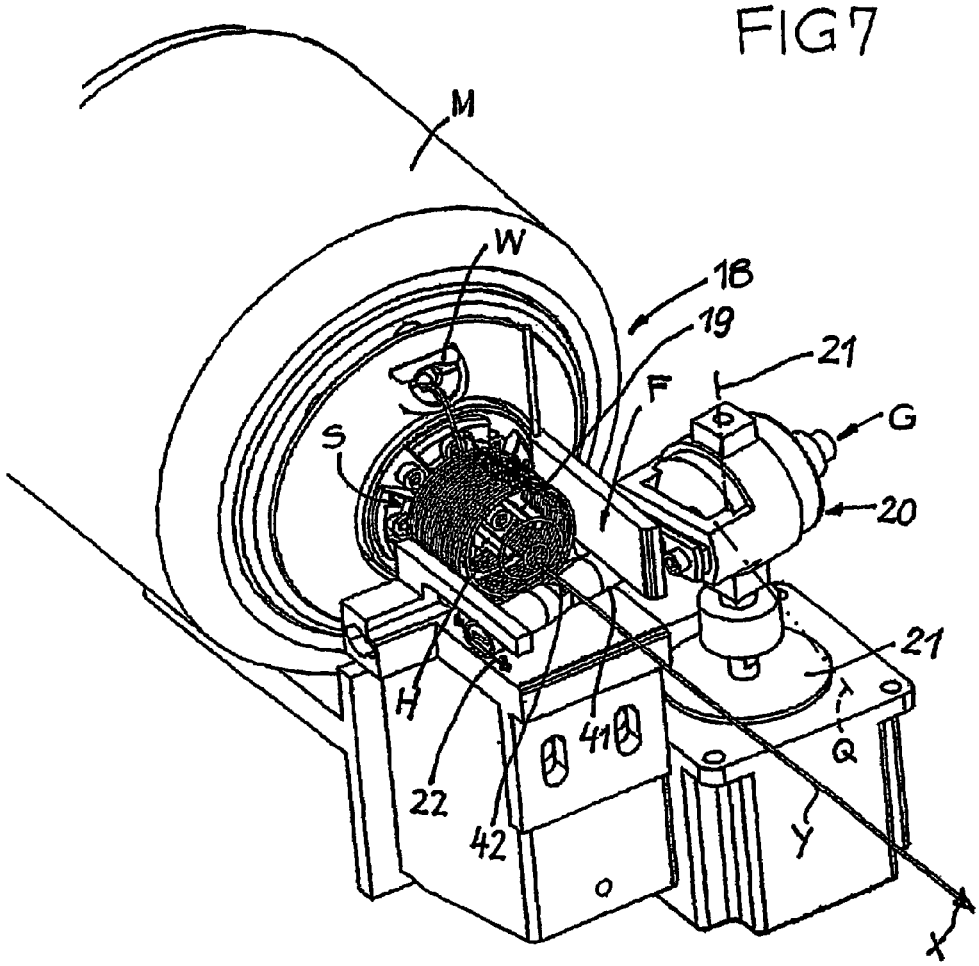
FIG. 7 is a perspective view of a yarn feeding device.

FIG. 7 illustrates a yarn feeding device 18 for carrying out the method. Several details of the yarn feeding device 18 are shown in FIGS. 8, 9, 10, 11 and 13. The yarn feeding device 18 of FIG. 7 e.g. serves for feeding weft yarn Y into a jet weaving machine, e.g. an air jet weaving machine, the insertion system A of which is unable to measure the weft yarn length by itself. For this reason the assemblies H, G are provided in the yarn feeding device 18.

The driving motor M of the winding element W is received in a housing. The winding element W rotates in relation to the stationary support S which is formed as a kind of a rod cage having circumferentially distributed, freely ending rods 19 extending substantially parallel to the withdrawal direction X. The assembly H is provided at the lower side of the support S and will be described in detail with the help of FIGS. 8-10, while the assembly G is provided downstream of support S and is constituted by a controlled yarn clamp 20.

The yarn clamp 20 is pivoted backwards and forwards by means of an auxiliary drive 21 and about a pivot axis 21' oriented perpendicular to the withdrawal direction X. The yarn clamp 20 comprises a tubular projection 41 and a notch-shaped clamping region 42 for the weft yarn. The projection 41 extends from outside and perpendicular to the pivot axis 21' essentially below a prolongation of the support axis. A double arrow 22 indicates how the yarn clamp 22 is adjusted back and forth by means of the auxiliary drive 21. The rotational auxiliary drive 21 includes, e.g., a rapidly responding step motor. Alternatively, a linear drive assembly could be provided which reciprocally displaces the yarn clamp 20 parallel to the withdrawal direction and corresponding to the double arrow 22. Guiding surfaces F axially overlap the support S and serve for the yarn winding package or the set free yarn winding package section, respectively. The guiding surfaces F, in this embodiment, are arranged at the lower side and at both sides in order to guide and support the set free yarn winding package section, if necessary.

Basically, it may be expedient to remove the yarn clamp 20 in the end phase of an insertion temporarily from the moving space of the yarn, e.g. by means of a separate, not shown, actuator or even by means of the auxiliary drive 21, e.g. into a position Q in FIG. 7. Alternatively, a shield could be moved for a short while above the clamping region 42. As a further alternative, a permanent deflector could be provided there. Those measures hinder that the yarn can be caught accidentally by the yarn clamp 20 at the end of an insertion.

Figure 8:
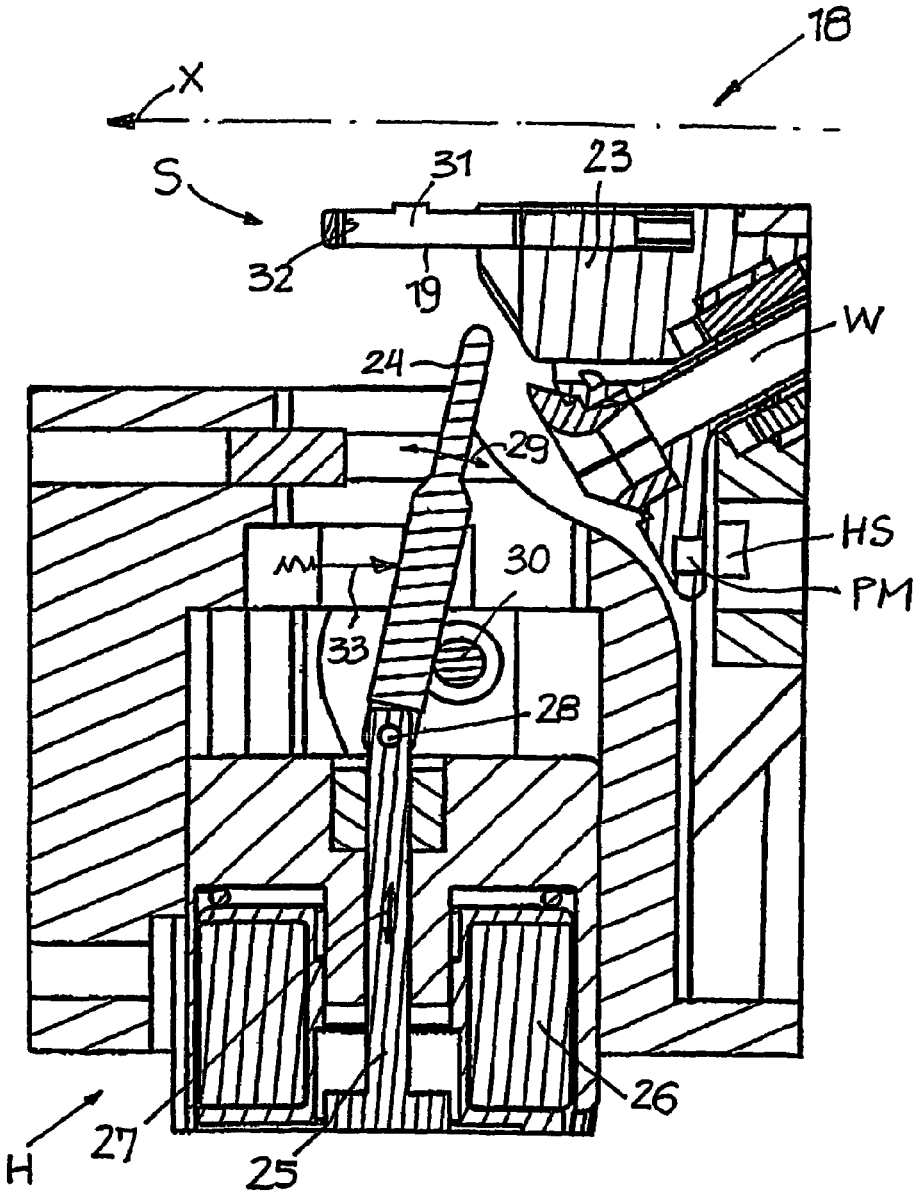
FIG. 8 is a radial section belong to FIG. 7.

FIG. 8 is radial section of a variant of the yarn feeding device 18. In this embodiment, the assembly H is provided below the support S and is constituted by a stopping device having a movable stop element 24. The rods 19 of the support S are provided in a stationary carrier 23 in a freely cantilevering fashion. The winding element W rotates around the support SW. The carrier 13, e.g. is rotatably supported on the driving shaft of the winding element W; however, not shown solenoid arrangements hinder the carrier 23 from rotating with the driving shaft such that the carrier 23 remains stationary.

The stop element 24 is pin-shaped and is connected via a hinge 28 having a hinge axis perpendicular to the withdrawal direction X with an armature 25 of a solenoid drive 26 (linear drive) by which the stop element 24 is reciprocally movable in the direction of the double arrow 27 between the shown release position and an engagement position. In the engagement position the free end of the stop element 24 engages into a cut-out or a longitudinal guide 13 of one rod 19. At the left end in FIG. 8 of the longitudinal guide 31 a stop 32 is provided which defines a stop position in which the engaging stop element 24 hinders that weft yarn will be further withdrawn from the windings on the support S. The free end of the stop element 24, e.g., is reciprocally movable in the direction of the double arrow 21 in the hinge 28. A stop 30 defines the home position of the stop element 24 shown in FIG. 8. In the home position the stop element can be brought from the shown release position upwardly into the longitudinal guide 31 such that it will be placed in front of the yarn exiting from the winding element W and behind at least a first yarn winding in withdrawal direction which first yarn winding already is placed on the support S. Thanks to the hinge 28 during the further formation of the yarn windings the stop element 24 is carried along by the axially growing yarn winding package until it is caught in the stop position at stop 32. The insertion is terminated as soon as the withdrawn weft yarn is caught at the stop element 24. After the termination of the insertion the stop element 24 again is pulled back by the solenoid drive 26 into the release position such that the yarn winding package can further overfill the support S or such that again weft yarn can be withdrawn. For returning the stop element 24 in the home position shown FIG. 8 a power drive 33 is provided, which is stationary with respect to the stop element 24 and which may be, e.g., a controlled solenoid 33. The solenoid 33 only is active when the stop element 24 has to be returned. The stop element 24 only has to control the end of an insertion. The start of an insertion is controlled by the yarn clamp 20.

Figure 10:
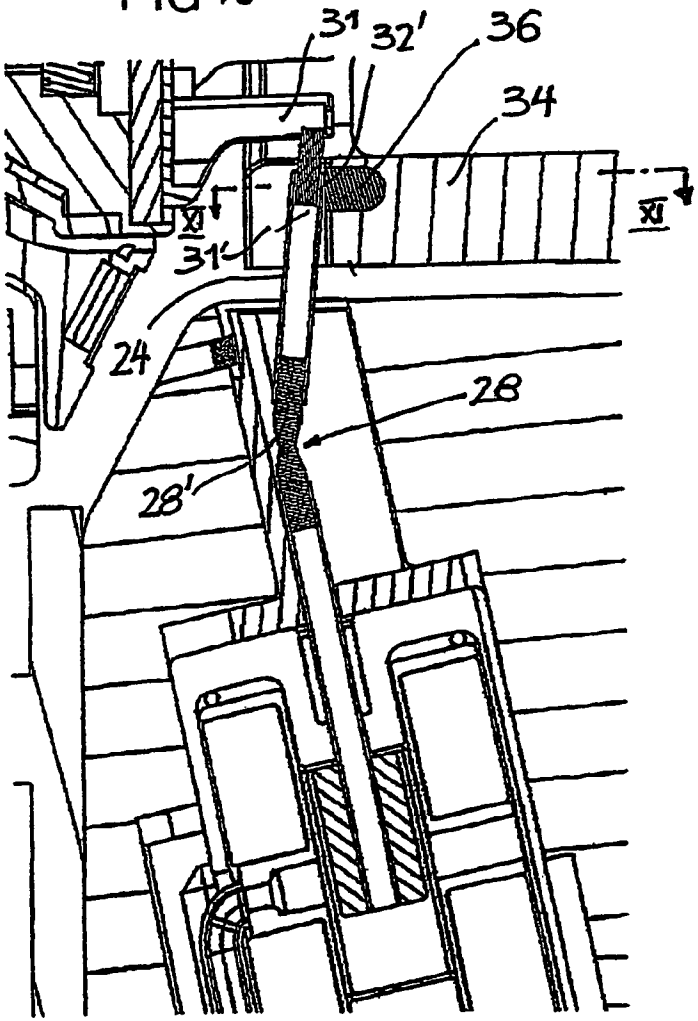
FIG. 10 is a radial sectional view similar to FIG. 9 of the same embodiment in another position of the stop element.
Figure 9:
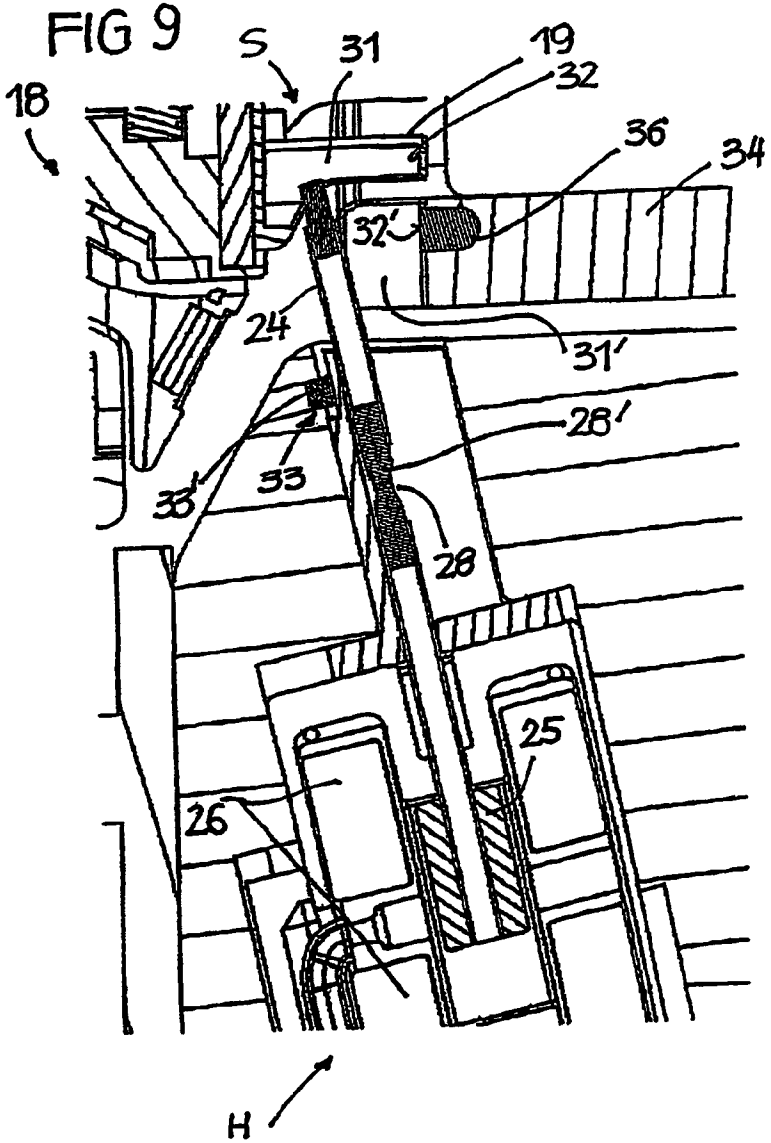
FIG. 9 is a radial section similar to the radial section of FIG. 8 of another embodiment, in a home position of a movable stop element.

FIGS. 9 and 10 show a detail variant having a stop element 24 the hinge 28 of which is constituted by an elastic hinge section 28' which provides movability in all directions. The hinge section 28' consists, e.g., of an elastomeric part. The adjustment of the stop element 24 from the stop position shown in FIG. 10 back into the home position shown in FIG. 9 is carried out by the inherent elasticity of the hinge section 28', so to speak, automatically. The spring action in the spring section 28' ought to be as weak as possible in order to resist as little as possible the yarn winding package conveying the stop element 24 forward. A permanent magnet 33 can be provided for safety's sake in order to ensure in co-action with a magnetic section 35 the home position of the stop element 24 as shown in FIG. 9.

Adjacent to the support S or the rods 19, respectively, in this embodiment a stationary structure 34 is provided distant from the spaced apart from the outer sides of the rods 19 and includes a longitudinal guide 31' for the stop element 24. Within rod 19 or in-between two rods 19 a cut-out 39 is provided as a longitudinal guide or as a passing path for the stop element 24. Within the structure 34 as a stop 32' a retainer 36 is provided which defines a damping element and which will be explained with the help of FIG. 11. The retainer 36 has to define the stop position of the stop element 24 and constitutes in co-operation with the stop element 24 a damping device of the yarn feeding device 18.

Figure 11:
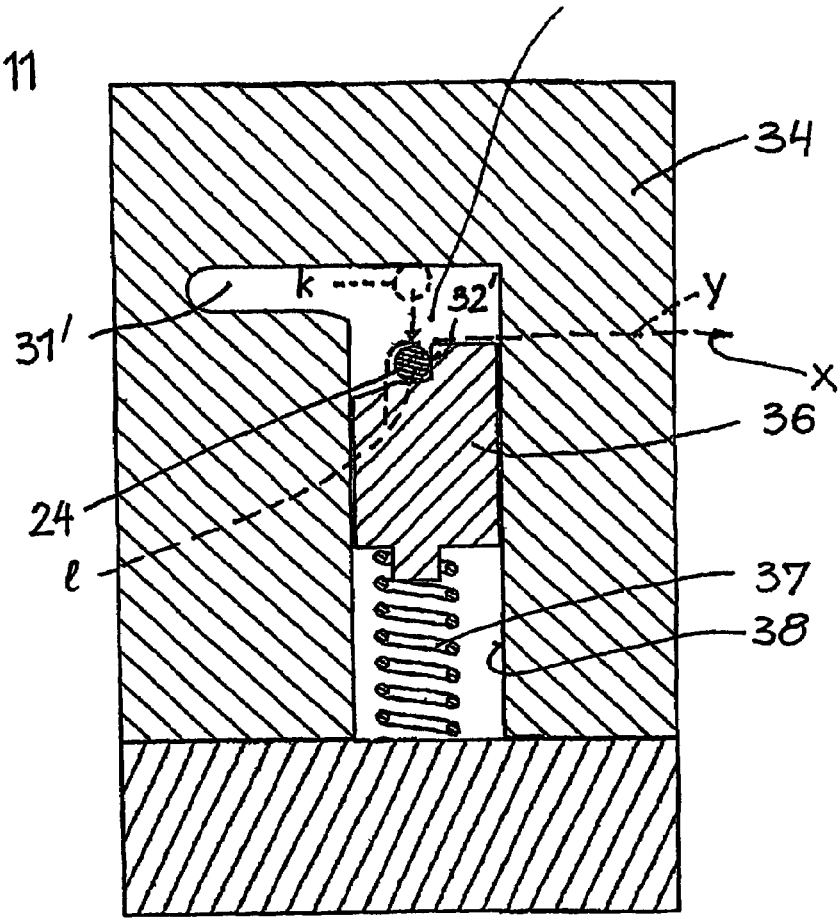
FIG. 11 is a detail section in the plane XI-XI in FIG. 10.

The sectional view in FIG. 11 shows that the longitudinal guide 31' is a slot guiding the engaging stop element 24 while the yarn winding package conveys the stop element 24 forward. In a lateral guide notch 38 substantially oriented in circumferential direction of the support S or oriented in a direction which is oblique in relation to the withdrawal direction, the retainer 36 is displaceable counter to the force of a spring 37. The retainer 36 on the one hand forms the stop 32' for defining the stop position, and on the other hand constitutes a damping element which elastically can be displaced by the reaction force of the decelerated weft yarn via the stop element 24 from a first catching position k over a damping stroke into a second catch position I. During this stroke kinetic energy will be dissipated such that a yarn tension rise at the end of an insertion is moderated or even avoided.

In a not shown alternative embodiment the stop element 24 itself could be displaced substantially in circumferential direction of the support S with a counter force and resiliently and could directly constitute the damping device.

Figure 12:
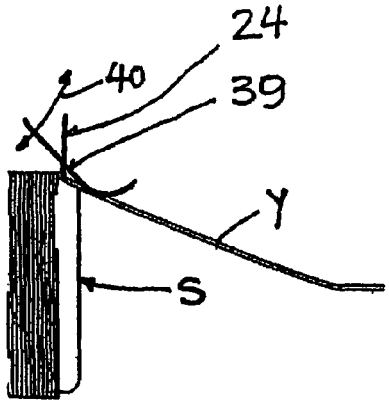
FIG. 12 is a schematic illustration of a further embodiment.

FIG. 12 shows a back-holding element 39 associated to the support S (a lamella or a brush) which extends obliquely downwards in withdrawal direction for co-operation with the front end of the support S or the weft yarn, respectively, which weft yarn just is in progress to be caught at the stop element 24 in the stop position. The back-holding element 33 is adjustable, e.g., in the direction of a double arrow 40 back and forth in order to act indeed only towards the end of an insertion on the yarn to reduce the yarn speed.

Figure 13:
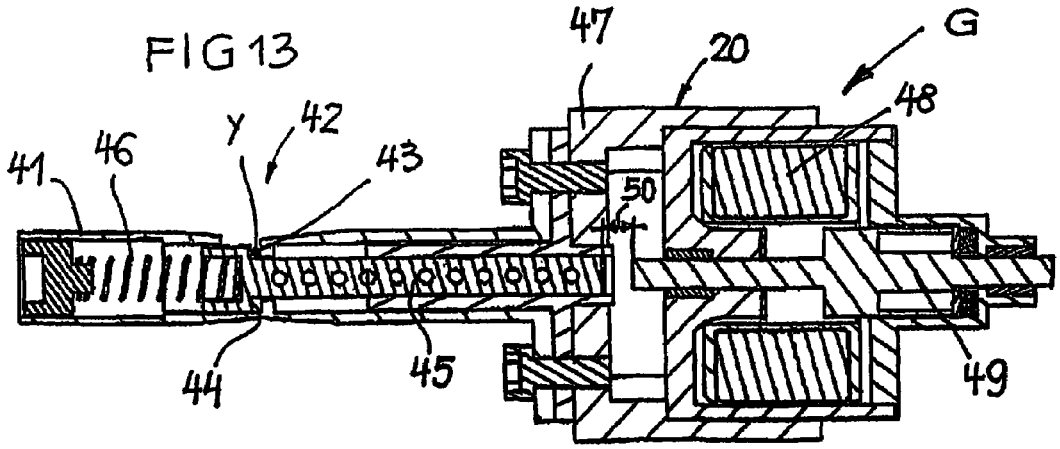
FIG. 13 is a longitudinal section of a yarn clamp as it is used e.g. in FIG. 7.

FIG. 13 illustrates the structure of the controlled yarn clamp 20 of FIG. 7. The tube-shape projection 41 is secured to a housing 47 receiving the solenoid drive 48, 49 serving to adjust the yarn clamp from the shown clamping position into the not shown passive position. The notch-shaped clamping region 42 is defined by a boundary surface 43 of an outwardly open notch of the projection 41 and a clamping surface 44 provided at a shoulder of a bolt 45 which is slideably received in the projection 41. The bolt 45 is loaded in clamping direction by the force of a spring 46. The spring 46, finally, serves to hold the weft yarn Y. A plunger-shaped armature 49 is provided in the solenoid drive 48. The armature rests in the initial position as shown in FIG. 13 as long as the solenoid 48 is not excited. In this initial position the armature 49 is spaced apart from the bolt 45 by an intermediate distance 50. The intermediate distance 50 allows that the armature 49 upon excitement of the solenoid 48 accelerates rapidly and then hits with full vehemence against the bolt 45 such that the held weft yarn Y is released abruptly (opening time in the range of one millisecond).

The yarn clamp 20 is adjusted from the clamping position shown in FIG. 13 into the passive position by means of a trig signal transmitted from the weaving machine. By this adjustment the weft yarn Y is released for withdrawal in order to start the insertion cycle. On the other hand, e.g., the stop element 24 is pulled back from the engaging stop position at the point in time after the yarn clamp 20 is brought into the clamping position by a signal generated from a not detailed shown control system of the yarn feeding device. In some cases even a signal of the control device of the yarn feeding device may be used to control the yarn clamp 20. An adjustment of the stop element 24 from the home position into the engagement position as well may be controlled by a signal of the control device of the yarn feeding device, e.g., as soon as the counted number of wound on yarn windings reaches a target value. A Hall sensor HS (FIG. 8) placed in the stationary part of the yarn feeding device may e.g. serve to count the wound on yarn windings. The Hall sensor may be aligned to a permanent magnet PM provided at the winding element W.

Figure 14:
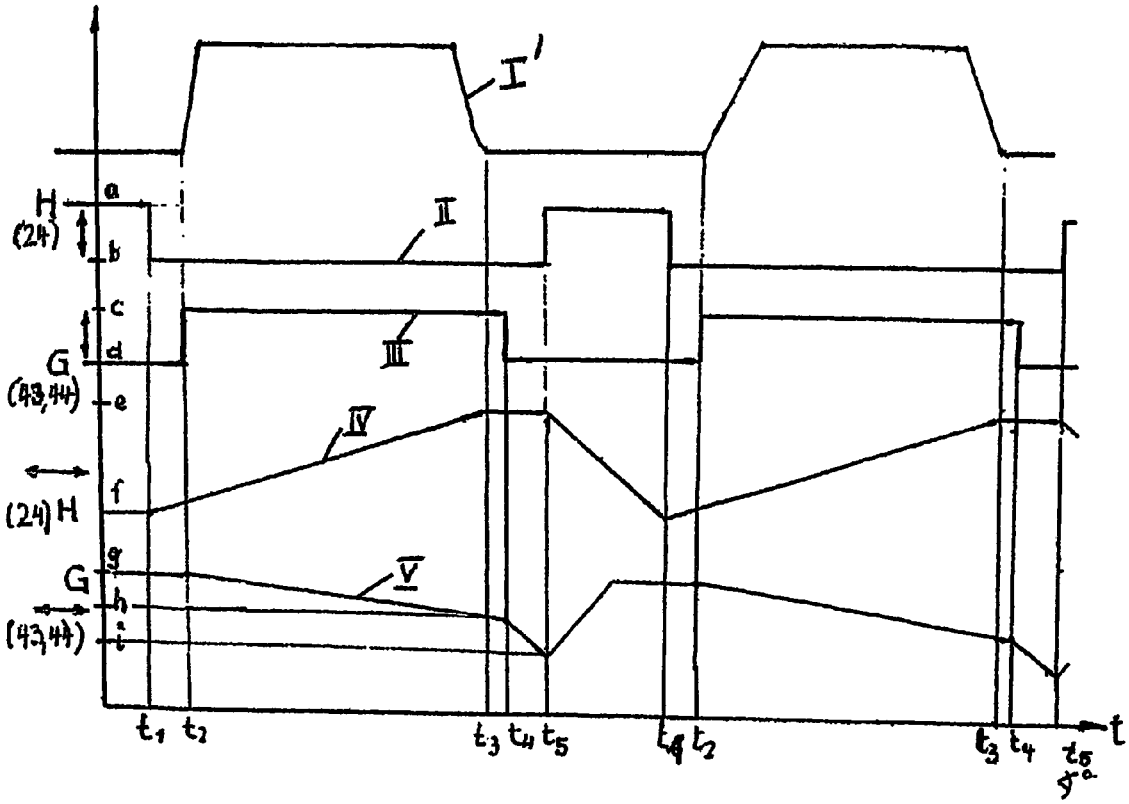
FIG. 14 is a diagram showing by means of different curves the operation of several components in relative association during the method.

The method carried out with the yarn feeding device 18 will be explained with the help of the diagram of FIG. 14 for two subsequent insertion cycles (notch I'). The horizontal axis shows the time t or the rotational angle of the weaving machine, respectively, while the vertical axis among others represents the travel strokes of the assemblies H, G in two opposite direction.

The horizontal lower parts of the notch I' represent times during which no yarn consumption takes place, while arc-shaped parts of the curve represent respective insertions during which the predetermined weft yarn lengths are inserted by the insertion system A into the weaving shed of the weaving machine.

The curve II indicates the substantially radial adjustment of the assembly H, i.e. of the stop element 24, between the release position a and the engagement position b. The curve III indicates the adjustment of the assembly G, i.e., of the clamping surface 44 relative to the boundary surface 43 of the yarn clamp 20 in longitudinal direction of the projection 41 between the clamping position d and the passive position c. The curve IV indicates the travel of the stop element 24 in the assembly H in and counter to the withdrawal direction between the home position f similar as shown in FIG. 8 and the stop position e similar as shown in FIG. 10. The curve V indicates the adjustment of the assembly G, i.e. of the yarn clamp 20, in the direction of the double arrow 22 in FIG. 7, i.e., in and counter to the withdrawal direction between a position g in which the yarn clamp 20 is furthest from the support S over an intermediate position h into a position i in which the yarn clamp 20 is closest to the support S.

According to curve II the stop element 24 in the release position and prior to an insertion, is adjusted at a point in time t1 into the engagement position b, more precisely according to curve IV in the home position f close to the winding element W. Now successively new yarn windings are formed such that according to curve IV the stop element 24 conveyed by the windings gradually reaches the stop position e until the point in time t3. When at the point in time t1 the stop element 24 is adjusted into the engagement position b, the yarn clamp 20 still is in the clamping position d according to curve III, such that the yarn clamp 20 still holds the weft yarn. During this time period the yarn clamp 20 still is in the position g with the largest distance from the support S and according to curve V. For example, at point in time t2 a trig signal is transmitted. The yarn clamp 20 now is adjusted into the passive position c. The insertion starts. In the passive position the yarn clamp 20 gradually is moved into the intermediate position h and according to curve V such that the yarn clamp 20 will reach the intermediate position h at point in time t4. At point in time t3 the insertion is to be terminated. The stop element 24 has reached the stop position e and stops, according to curve IV, such that the weft yarn is caught. The insertion has ended. At point in time t4 the yarn clamp 20 again is adjusted into the clamping position d according to curve III such that the yarn clamp 20 again holds the yarn. Thereafter the closed yarn clamp 20 is moved from the intermediate position h according to curve IV into the position i closest to the support S such that the yarn clamp relaxes the yarn section between the stop element 24 and yarn clamp 20. After the relaxation of the yarn in point in time t4 the stop element 24 is moved into the release position according to curve II. This movement is carried out without significant friction on the yarn and without jerking motions of the yarn, because the yarn already is relaxed. As soon as the stop element 24 has reached the release position, the stop element 24 is brought by the power drive 33 according to curve IV from the stop position e into the home position f close to the winding element W until the home position f is reached in point in time t1. Then the stop element 24 again is adjusted into the engagement position b (curve II) before at point in time t2 the next insertion will start. After the stop element 24 has been brought into the release position at point in time t5 in curve II, the yarn clamp 20 is moved according to curve V in withdrawal direction from the position i closest to the support S gradually into the position g in which the yarn clamp (according to curve III) holds the yarn until the point in time t2, i.e., the start of the insertion.

According to curve V the yarn clamp 20 first is adjusted gradually from the position g into the intermediate position h such that the yarn clamp 20 reaches the intermediate position h at point in time t4. Only then the further adjustment into the position i is carried out and after the stop element 24 has been adjusted into the release position.

Alternatively, the yarn clamp 20 may, different from the curve V, remain approximately in the position g between the points in time t2 and t3. The yarn clamp 20 then will be adjusted first after point in time t4 in one stroke into the position i such that it reaches the position i at point in time t5 or shortly before.

Figure 15:
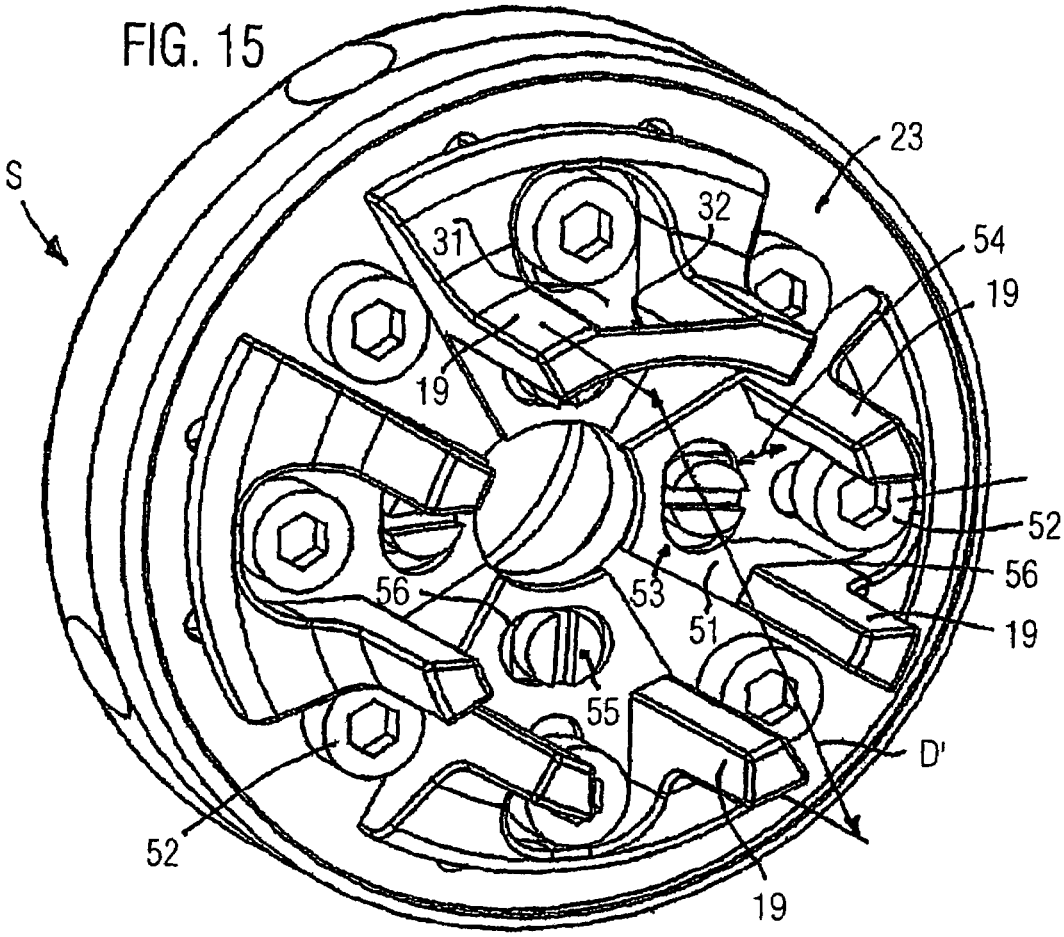
FIG. 15 is a perspective front view of a detail of FIG. 7.

In case of only one stop element 24 the releasably weft yarn length only can be an integer multiple of the circumferential length of the support S (diameter D'). In order to adapt the weft yarn length to the weaving width of the weaving machine the diameter D' has to be variable. For this purpose and according to FIGS. 15 and 16 the support S is designed with a variable diameter. The rods 19 are, preferably in groups, provided at fingers 51 which are radially movable in guides of the stationary carrier 23. The respective radial adjustment position of the fingers 51 is fixed by at least one fastening screw 52. Each finger 51 has an individual eccenter adjustment device 53 allowing to steplessly vary the diameter D' of the support S. The eccenter adjustment device comprises an adjusting eccentric portion 55 penetrating a cut-out 56 in the finger 51. The function of the adjusting eccentric portion 55 will be explained with reference to FIG. 16.

Figure 16:
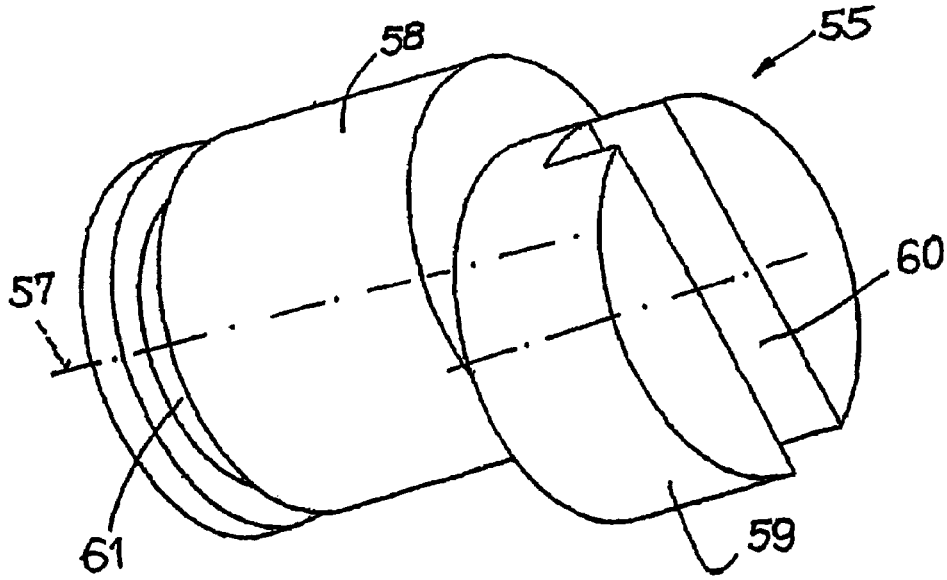
FIG. 16 is a detail of FIG. 15, in a perspective view and with enlarged scale.

The eccentric portion 55 is rotatably supported about the axis 57 in carrier 23 in FIG. 16, and particularly by means of a rotatable portion 58 (secured in place by a not shown safety element engaging into circumferential groove 61). The adjusting eccentric portion 55 comprises an eccentric portion 59 the eccentric axis of which is offset in relation to the rotation axis 57, and a handle 60 for the engagement of a turning tool. The eccentric portion 59 engages into the cut-out 56 which extends substantially in circumferential in the finger 51, preferably in a sliding fit. By turning the adjusting eccentric portion 55, e.g. over a limited rotational range of 180°, the entire adjusting range for each finger 51 is defined. An adjustment is carried out after first loosening the fastening screw 52. A new adjustment position is fixed by again tightening the fastening screw 52.

Alternatively (not shown) the adjusting eccentric portion 55 only could be supported rotatably in finger 51 such that it engages with its eccentric portion 59 into a cut-out in the carrier 23 which cut-out is similar to the cut-out 56.

Figure 17:
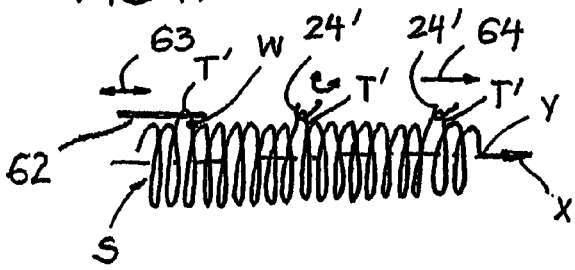
FIG. 17 is a schematic view of a method and device variant.

FIG. 17 indicates schematically how according to the method a number of windings is formed in the yarn winding package. The number of windings corresponds to several weft yarn lengths. For defining the length of each weft yarn section several stop elements 24' are provided which expediently move together with the yarn winding package in withdrawal direction and which can be brought into engagement into selected windings T'. The windings T' are formed larger than the adjacent windings T, e.g. with the help of a device 62 which preliminarily is placed close to the winding element W (double arrow 63) and which then forms one larger winding T'. A respectively selected of the stop elements 24' engages into one of the enlarged windings T' in order to terminate the insertion of all of the windings T' located downstream in withdrawal direction. Later, this stop element 24', e.g. is returned by a turning motion into a release position, as soon as the next insertion starts, which next insertion then will be terminated by the subsequent engaging stop element 24'.

Figure 18:
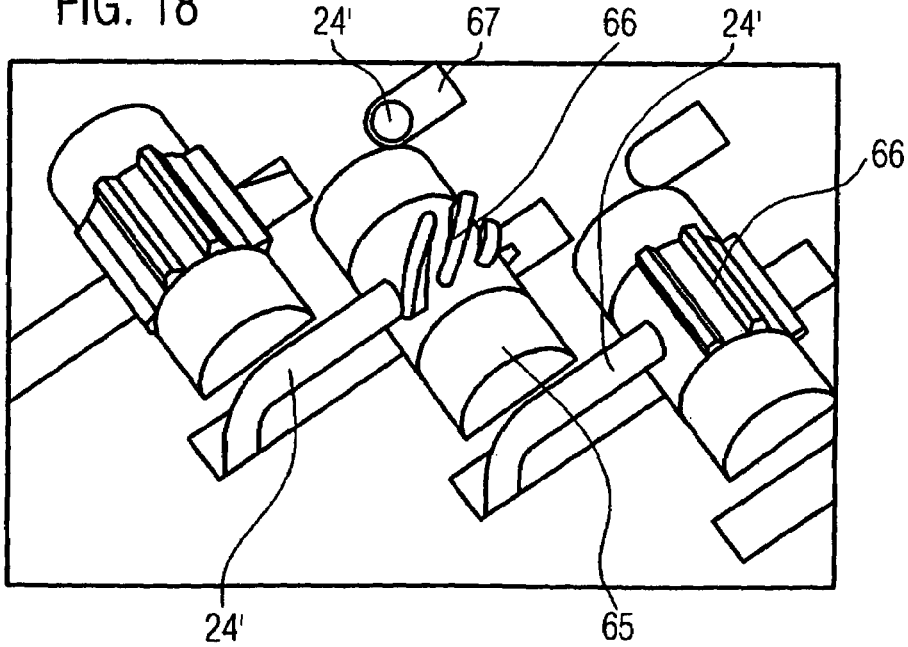
FIG. 18 is a top view of a detail of a yarn feeding device of FIG. 17.

In FIG. 18 the stop elements 24' are formed like hooks and are held in rotatable bearings 65. The stop elements 24' can be turned between the engagement positions and the released positions back and forth by means of gear rims 66, 67. An arrow 64 indicates the movement of the stop elements 24' together with the forwardly conveyed yarn winding package in FIG. 17.

In the yarn path downstream of the yarn clamp 20 a controlled yarn brake may be provided (not shown).

In case of a weaving machine the insertion system of which automatically is capable of mechanically defining the weft yarn length (projectile weaving machine or rapier weaving machine) the assemblies H, G may be omitted.

Figure 19:
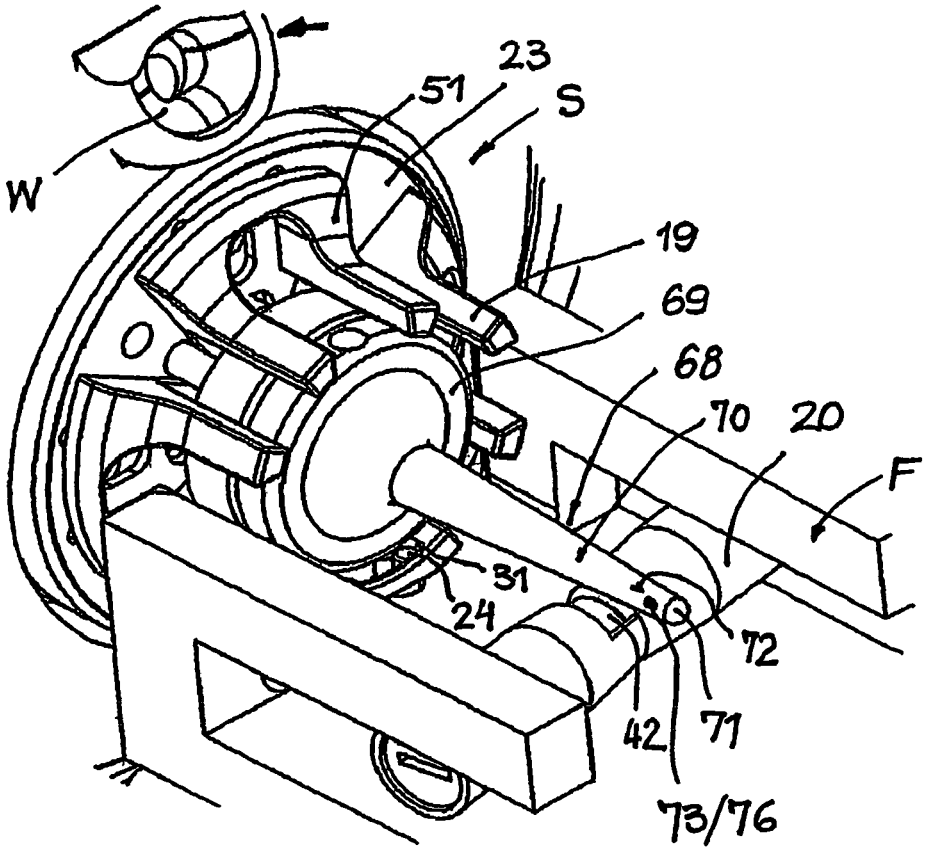
FIG. 19 is a perspective view of a further detail.

During withdrawal of the yarn from the set free winding package section B the yarn of the frontmost winding first runs directly substantially radially inwards before running further substantially in axial direction. Depending on the adhesion between the yarn windings and the elasticity and the liveliness of the yarn material occasionally almost a full winding may move inwardly or the yarn may run spiralling inwardly from the frontmost winding, respectively. This could mean that occasionally a snarl is formed which then, in case of a lively yarn material, might have the tendency to fully get twisted at the location where the yarn crosses. Due to the high withdrawal speed such a snarl could result in a knot or may not be removed but would be inserted. This could cause a fabric fault or an insertion disturbance. For this reason a snarl suppressing body 70 is provided in FIG. 19 which eliminates the above-mentioned effect. The rods 19 at the fingers 51 which are mounted in the support S at the carrier 23 about which the winding element W rotates, e.g. in the direction of the arrow, define a support surface having a certain axial length and the above-mentioned diameter D'. The snarl suppressing body 68, 70 is stationarily secured by a foot part 69 at support S within the rods 19. The snarl suppressing body 68, 70 may be easily removably inserted or even screwed in. The snarl suppressing body 68, 70 extends substantially in the direction of the axis of the support beyond the front end of the support S, i.e. beyond the front end defined by the rods 19, and has a free end 71. In the shown embodiment a tapered rotation symmetrical pin 70 is provided the diameter of which is significantly smaller than the diameter of the supporting surface. At least the free end 71 has a diameter which only is a fraction of the diameter of the supporting surface. The pin 70 may be linearly conical or may have a concave or convex generatrice. It even may be formed like a pointed cone or as a cylinder. The coat surface 72 of the pin ought to be smooth, in some cases it even might carry a low friction overlay in order to generate as little friction resistance for the yarn as possible. In the shown embodiment the snarl suppressing body 68 reaches with its free end 71 in withdrawal direction beyond the position of the yarn clamp 20. The yarn clamp 20 is positioned in the withdrawal path of the yarn from the support S outside of the support axis and substantially aligned with the stop element 24 such that the yarn running off from the stop element 24 safely reaches the clamping section 42. FIG. 19 also shows the guiding slot 31 for the stop element 24.

The free end 71 of the pin 70 of the snarl suppressing body 68 does not need to be necessarily downstream of the yarn clamp 20. It is possible to place the free end 71 exactly at the position of the yarn clamp 20, or even between the yarn clamp 20 and the support S. In each case the snarl suppressing body 68 ought to project beyond the front end of the support S in order to be able to hinder that snarls get twisted and occasionally even form knots on their way downstream.

In operation the withdrawn yarn at least sometimes may contact the coat surface 72. In case that a snarl is in progress which has the tendency to twist about its crossing location, e.g. in case of lively yarn material, this is hindered by the bodily presence of the snarl suppressing body 68. A snarl cannot get twisted but will be opened and consumed or removed. Surprisingly, a particularly positive effect of the snarl suppressing body 68 is a very calm run behaviour of the yarn into the insertion system.

The snarl suppressing body 68 may consist of plastic material or metal. Instead of a pin several parallel or conically converging wire section or the like could be employed. As mentioned, the conical pin 70 could be formed with a concave or convex generatrice of its coat surface 72.

Figure 20:
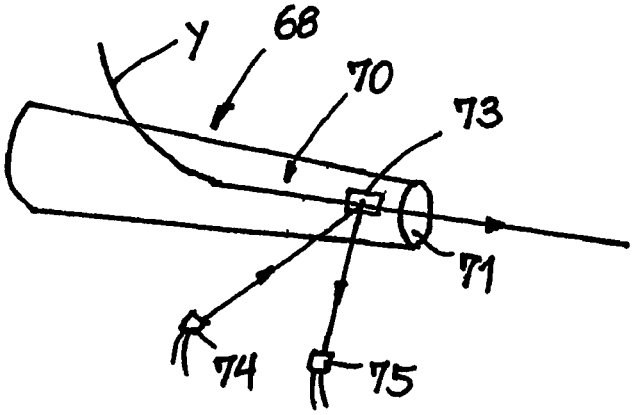
FIG. 20 is a detail variant in a perspective view.
Figure 21:
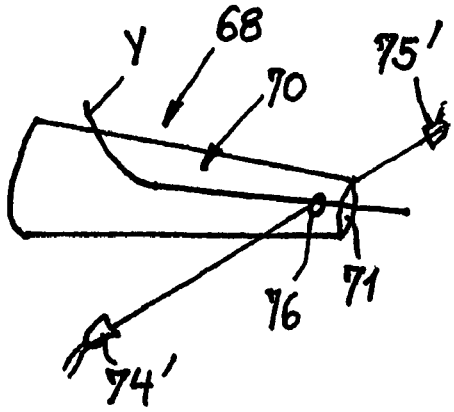
FIG. 21 is a further variant in a perspective view.

Advantageously, the snarl suppressing body 68 may be used to place a reliable yarn withdrawal sensor (FIGS. 20 and 21) for detecting the withdrawn windings. In FIG. 20 a reflecting surface 73 (e.g. a mirror) is placed on or in the coat surface 72. The surface 75 co-acts with an optoelectric sensor 74, 75. In FIG. 21 a lateral passage 76 is formed in the pin 70. A detection beam of a light emitting sensor 74', 75' is directed through the lateral passage 76. In FIG. 20 each winding is detected once (one count) per passage, in FIG. 21 each winding is detected twice (two counts) per passage.

The invention claimed is:

1. A yarn feeding device for a weaving machine including at least one winding element being rotatably driven in relation to a stationary, substantially drum-shaped support for forming a tubular yarn winding package comprising adjacently lying windings of substantially equal form, the yarn winding package being conveyed forwards in a withdrawal direction on the support, and a mechanical weft yarn length measuring assembly having at least one stop element for co-operation with the support, the stop element being adjustable between an engagement position with an engagement from an outer side into the support and a retracted release position, wherein the stop element is movable in the withdrawal direction relative to the support, wherein a power drive is provided for moving the stop element opposite to the withdrawal direction into a predetermined home position close to the winding element, and wherein the stop element in its engagement position is movable from an end position in the withdrawal direction to a predetermined stop position exclusively by the growing yarn winding package.

2. The yarn feeding device according to claim 1, wherein the mechanical weft yarn length measuring assembly in a downstream yarn path of the stop element includes a yarn clamp, which is adjustable between a clamping position and a passive position, and a drive for adjusting the yarn clamp from the clamping position into the passive position after an adjustment of the stop element from the release position into the engagement position, and for adjusting the yarn clamp from the passive position again into the clamping position by holding the yarn prior to an adjustment of the stop element from the engagement position into the release position, the yarn clamp releasing a firmly held weft yarn for an insertion by the adjustment from the clamping position into the passive position.

3. The yarn feeding device according to claim 2 further including an auxiliary drive for adjusting the yarn clamp back and forth substantially in and opposite to the withdrawal direction, wherein the auxiliary drive, the drive for adjusting the yarn clamp and a stop element drive for the stop element co-operate such that the yarn clamp in its clamping position is movable opposite to the withdrawal direction or in a direction towards the stop element, respectively, prior to an adjustment of the stop element from the engagement position into the release position.

4. The yarn feeding device according to claim 1, wherein a hinge is provided between the stop element and a stop element drive serving to adjust the stop element between the engagement position and the release position, and wherein the stop element is movably guided in the withdrawal direction either about a hinge axis extending perpendicular to the withdrawal direction or in a guide extending in the withdrawal direction, the guide being provided either in the support or in a structure located adjacent to the support.

5. The yarn feeding device according to claim 1, wherein the power drive includes a controlled solenoid which is stationarily provided in relation to the stop element and which, when activated, produces a force at a portion of the stop element in a direction opposite to the withdrawal direction.

6. The yarn feeding device according to claim 1, wherein the support or a stationary structure located adjacent to the support has a stop for defining the stop position of the stop element.

7. The yarn feeding device according to claim 4, wherein the stop element in the stop position is deflectable in a circumferential direction of the support with a predetermined resilient counter force.

8. The yarn feeding device according to claim 7, wherein the stop element is deflectable in the circumferential direction of the support against a predetermined counter force and is resiliently returnable by a springy section of the hinge.

9. The yarn feeding device according to claim 7, wherein a sidewardly positioned retainer is provided in the support or in a stationary structure located adjacent to the support, the retainer forming a stop for defining the stop position and being displaceable in the circumferential direction of the support by the stop element and against the predetermined resilient counter force, and returning automatically under the counter force.

10. The yarn feeding device according to claim 3, wherein the yarn clamp is provided with a tubular projection of a small diameter and including a notch-shaped yarn clamping region, the projection being placed close to a front end of the support and extending freely ending from a support location located outside of an axial projection of an outer diameter of the yarn winding package essentially crosswise to the withdrawal direction through a yarn withdrawal path, and wherein the auxiliary drive is arranged in the support location, the auxiliary drive comprising a rotational drive having a rotation axis substantially perpendicular to the withdrawal direction and to a longitudinal axis of the projection and a linear displacement drive for a displacement direction essentially parallel to the withdrawal direction.

11. The yarn feeding device according to claim 10, wherein the notch-shaped yarn clamping region is defined by a boundary surface of an outwardly open notch formed in the projection and by a clamping surface of a bolt longitudinally displaceably received in the projection, and wherein the bolt in the clamping position of the yarn clamp is loaded by a spring force and is pressed with its clamping surface with the weft yarn held in-between against the boundary surface.

12. The yarn feeding device according to claim 2, wherein the drive for adjusting the yarn clamp includes a switching magnet and a plunger-shaped armature, the armature engaging at a bolt opposite to a spring force when a current is supplied to the switching magnet, and wherein in the clamping position of the yarn clamp a predetermined intermediate distance is formed between the armature and the bolt, while no current is supplied to the switching magnet and the armature maintains a predetermined initial position.

13. The yarn feeding device according to claim 1, wherein at least one outer guiding surface for a yarn winding package section set free during overfilling the support is arranged in the withdrawal direction following the support, the guiding surface extending substantially in the withdrawal direction, and extending in the withdrawal direction beyond the yarn clamp and overlapping a front end of the support.

14. The yarn feeding device according to claim 13, wherein the guiding surface at least grips from an outer side around more than a lower half of the yarn winding package.

15. The yarn feeding device according to claim 13, wherein the guiding surface comprises single partial surfaces, finger-shaped elements or rod-shaped elements in a circumferential direction of the yarn winding package.

16. The yarn feeding device according to claim 13, wherein at least a part of the guiding surface below the set free yarn winding package section is inclined obliquely upwardly in the withdrawal direction.

17. The yarn feeding device according to claim 1, wherein a back holding element is provided over a top of the yarn winding package, the back holding element being one of a lamella, a brush and a lateral arm, the back holding element being movable from a raised neutral position to a lowered holding position, the back holding element in the holding position being in contact with the weft yarn or the support, and the back holding element extending obliquely downward from a top over an end of the yarn winding package at a withdrawal side while the end of the yarn winding package remains supported by the support.

18. The yarn feeding device according to claim 1, wherein the support is formed as a rod cage of a variable diameter and having rods extending substantially parallel to the withdrawal direction, outer peripheries of the rods forming a support surface for the yarn winding package, the rods being provided on fingers which are adjustably guided substantially radially with respect to an axis of the support in a stationary carrier and which can be fixed in different radial adjustment positions, and each of the fingers is equipped with an individual eccentric adjustment device including an adjusting eccentric portion accessible from a front side of the support.

19. The yarn feeding device according to claim 18, wherein the adjusting eccentric portion is supported in the carrier for rotation about an axis parallel to the axis of the support for an adjustment over a limited rotational range of 180°, and the adjusting eccentric portion engages with an eccentric portion into a cut-out of the finger, the cut-out being oriented in a circumferential direction.

20. The yarn feeding device according to claim 18, wherein the adjusting eccentric portion is supported in the finger for rotation about an axis parallel to the axis of the support over a limited rotational range of 180°, and the adjusting eccentric portion engages with an eccentric section into a cut-out in the carrier, the cut-out being oriented in a circumferential direction.

21. The yarn feeding device according to claim 1, wherein the support has an outer diameter between 20 mm and 50 mm.

22. The yarn feeding device according to claim 1, wherein the stop element is located at a lower side of the support.

23. The yarn feeding device according to claim 22, wherein a clamping section of the yarn clamp is positioned at an outer side of an axis of the support and in the withdrawal direction of the weft yarn substantially in alignment with the stop element.

24. The yarn feeding device according to claim 1, wherein a snarl suppressing body is centrally provided at the support in a removable fashion, the snarl suppressing body extending from the support at least approximately in alignment with an axis of the support in the withdrawal direction and having a free end located at a position in distance ahead of a front end of the support.

25. The yarn feeding device according to claim 24, wherein the snarl suppressing body has a rotationally symmetrical coat surface tapering in a direction towards the free end, and at least one yarn withdrawal sensor is structurally associated with the snarl suppressing body.

26. The yarn feeding device according to claim 24, wherein the snarl suppressing body comprises a pin.

27. The yarn feeding device according to claim 24, wherein the free end is located close to the yarn clamp in the withdrawal direction or in a downstream path of the yarn clamp.

28. The yarn feeding device according to claim 1, wherein a surface of the support is formed with a conicity tapering in the withdrawal direction with an inclination of about 1°.

29. The yarn feeding device according to claim 1, wherein an advance element is provided between the winding element and a surface of the support, the advance element being driven in synchronism with the winding element for a wobbling motion.

30. The yarn feeding device according to claim 18, wherein advance elements are provided between the rods of the rod cage of the support, the advance elements being connected to a common drive for driving the advance elements in synchronism with the winding element in the withdrawal direction, or back and forth in an oscillating fashion such that each of the advance elements during a forward motion protrudes outwardly relative to adjacent rods and beyond the adjacent rods, and during a backward motion returns inwardly relative to the adjacent rods and behind the adjacent rods.

31. The yarn feeding device according to claim 13, wherein the support is arranged for being pulled back relative to the yarn winding package and opposite to the withdrawal direction to set the yarn winding package section free.

32. The yarn feeding device according to claim 31, wherein a substantially stationary strip-off member is provided, and the support is arranged to be pulled back relative to the strip-off member.

33. The yarn feeding device according to claim 32, wherein a coaxial ring-shaped auxiliary support is structurally associated to a front end of the support, the auxiliary support having at least about the same outer diameter as an outer diameter of the support and being arranged to be adjusted between a yarn winding position at the front end of the support for prolonging the support and a gap position axially out of the yarn winding package, such that the auxiliary support forms an intermediate distance with the front end of the support in the gap position for withdrawing the weft yarn through the auxiliary support.

34. The yarn feeding device according to claim 33, wherein the auxiliary support is arranged to be shifted into the gap position relative to the substantially stationary strip-off member which is ring-shaped.

* * * * *

UNITED STATES PATENT AND TRADEMARK OFFICE

CERTIFICATE OF CORRECTION

PATENT NO. : 7,475,709 B2
APPLICATION NO. : 11/583330
DATED : January 13, 2009
INVENTOR(S) : Bjorn Halvarsson et al.

It is certified that error appears in the above-identified patent and that said Letters Patent is hereby corrected as shown below:

On the Title of the Letters Patent, please delete Item "(62) Division of Application No. 10/399 296, filed on Oct. 14, 2003, now Pat. No. 7 156 337" and insert:

Item

-- (62) Division of Application No. 10/399 296, filed as application No. PCT/EP2001/12024 on Oct. 17, 2001, now Pat. No. 7 156 337.

(30) Foreign Application Priority Data

October 18, 2000 (DE) 100 51 635
February 16, 2001 (DE) 101 07 311
June 26, 2001 (SE) 0102272
September 25, 2001 (SE) 0103209 --

Signed and Sealed this

Twenty-first Day of July, 2009

John Doll

JOHN DOLL
*Acting Director of the United States Patent and Trademark Office*